US010692477B1

(12) United States Patent
Wu

(10) Patent No.: US 10,692,477 B1
(45) Date of Patent: Jun. 23, 2020

(54) STRAINER ASSEMBLY FOR SNARE DRUM

(71) Applicant: K.H.S. Musical Instrument Co., Ltd., New Taipei (TW)

(72) Inventor: Wen-Ling Wu, New Taipei (TW)

(73) Assignee: K.H.S. Musical Instrument Co., Ltd., New Taipei (TW)

( * ) Notice: Subject to any disclaimer, the term of this patent is extended or adjusted under 35 U.S.C. 154(b) by 0 days.

(21) Appl. No.: 16/373,914

(22) Filed: Apr. 3, 2019

(51) Int. Cl.
*G10D 13/02* (2020.01)
*G10D 13/18* (2020.01)

(52) U.S. Cl.
CPC ..... *G10D 13/02* (2013.01); *G10D 13/18* (2020.02)

(58) Field of Classification Search
CPC ..... G10D 13/025
USPC ..... 84/415
See application file for complete search history.

(56) References Cited

U.S. PATENT DOCUMENTS 7,741,550 B2 * 6/2010 Miyajima ..... G10D 13/025 84/415
2016/0140939 A1 * 5/2016 Momose ..... G10D 13/025 84/415

* cited by examiner

*Primary Examiner* — Jianchun Qin
(74) *Attorney, Agent, or Firm* — Donald E. Stout; Stout, Uxa & Buyan, LLP

(57) ABSTRACT

A strainer assembly is provided for a snare drum having a shell and a bottom drumhead. The strainer assembly comprises a plurality of snare wires, a frame, a control mechanism, and a throw-off mechanism. Both ends of the snare wires are connected to the frame. The control mechanism includes a slidable part connected to a first end of the frame and a first button for controlling the vertical movement of the slidable part. The throw-off mechanism includes a slidable lower part connected to a second end of the frame and a second button for controlling the vertical movement of the slidable lower part.

10 Claims, 8 Drawing Sheets

STRAINER ASSEMBLY FOR SNARE DRUM

BACKGROUND OF THE INVENTION

1. Field of the Invention

The present invention relates to a strainer assembly for a snare drum.

2. Description of Related Art

Typically, a snare drum includes a plurality of snare wires and includes a snare strainer to switch the snare wires to a "snare on" state or a "snare off" state.

In conventional snare drums, the strainer couples to the snare wires, and when the position of the snare wires is operated at "snare on" or "snare off" state, they are either in contact or not in contact with the bottom drumhead. In the snare on state, the snare wires are vibrated by the vibration of the bottom drumhead when the snare drum is played. The tension of the snare wires may be fine-tuned or adjusted by a tension knob that is rotated to change the tone color produced by the snare drum.

U.S. Pat. No. 9,697,810 recites that conventional strainers for snare drum use a lever directly connected to a piston, wherein the lever pivots about an axis generally perpendicular to the piston so that, when the lever is pivoted from one position to another, the piston drops and the tension in the snares is released so that the snares are no longer in contact with the drumhead. Further, the strainer can include a throw-off mechanism configured to tension or quickly release the snares. However, strainer levers of the prior art systems may accidentally become dislodged because they do not have a positive lock mechanism. Therefore, the levers can accidentally vibrate loose and disengage to the off position during vigorous play. Therefore, the U.S. Pat. No. 9,697,810 discloses a strainer having a snare drum throw-off mechanism that provides the direct actuation means by which the snares are activated against the bottom drumhead without the assistance of a lever or cam device in the mechanism. The user pulls directly on the slide member of the throw-side component that is attached to the snare assembly itself, causing the wires to come in contact with the drumhead.

One disadvantage of the prior art is that when the snare wires are adjusted to a high tension, it is necessary to apply a large force to operate the strainer because of the frictional force.

SUMMARY OF THE INVENTION

In one general aspect, the present invention relates to a strainer assembly for a snare drum.

According to an embodiment, a strainer assembly is provided for a snare drum having a shell and a bottom drumhead. The strainer assembly comprises a plurality of snare wires, a frame, a control mechanism, and a throw-off mechanism. Each snare wire has a first end and a second end. The frame couples with the first end and the second end of each snare wire. The control mechanism comprises a first stationary base, a slidable part, a first control member, and a first button. The first stationary base connects to the shell. The slidable part is vertically movable in a chute of the first stationary base. The first button connects to the first control member to control a horizontal movement of the first control member so as to block or allow vertical movement of the slidable part. The slidable part connects to a first end of the frame. The throw-off mechanism comprises a slidable lower part connecting to a second end of the frame and a second button configured to control a vertical movement of the slidable lower part.

In one embodiment, the strainer assembly further comprises a first elastic member disposed in a first recess of the slidable part to provide a force to move the slidable part downward.

In one embodiment, the strainer assembly further comprises a second elastic member disposed between the first stationary base and the second control member to provide a force to return the first button to its initial position.

In one embodiment, the strainer assembly further comprises a first bracket to fix the first stationary base with the shell, wherein the first bracket comprises a first tension-adjusting member connecting to the first stationary base, and the first tension-adjusting member is configured to adjust a tension of the plurality of snare wires.

In one embodiment, the strainer assembly further comprises two handles respectively connected to the left side and right side of the slidable part.

In one embodiment, the throw-off mechanism further comprises a second stationary base, a second control member, a slidable upper part, and two touch protector. The second stationary base connects to the shell, wherein the slidable lower part is capable of being vertically moved in a chute of the second stationary base. The second control member connects to the second button. The second button controls a horizontal movement of the second control member so as to block or allow a vertical movement of the slidable lower part. The slidable upper part is vertically movable in the chute of the second stationary base and located above the slidable lower part. The slidable upper part is located at an initial position to block the second control member so that the second button cannot be pressed. The two touch protector connects to the slidable upper part and is manually operated to move the slidable upper part so that the second button can be pressed.

In one embodiment, the strainer assembly further comprises a first spring disposed in a first recess of the slidable upper part to provide a force to move the slidable upper part downward.

In one embodiment, the strainer assembly further comprises a second spring disposed between the second stationary base and the second control member to provide a force to return the second button to its initial position.

In one embodiment, the strainer assembly further comprises a second bracket, wherein the second stationary base is connected to the shell through the second bracket, and the second bracket comprises a second tension-adjusting member connecting to the second stationary base, and the second tension-adjusting member is used for adjusting the tension of the plurality of snare wires.

In one embodiment, the first end of the frame comprises two slits to receive a horizontal link rod connecting to a lower end of the slidable part.

DETAILED DESCRIPTION OF THE PREFERRED EMBODIMENT

Figure 1:
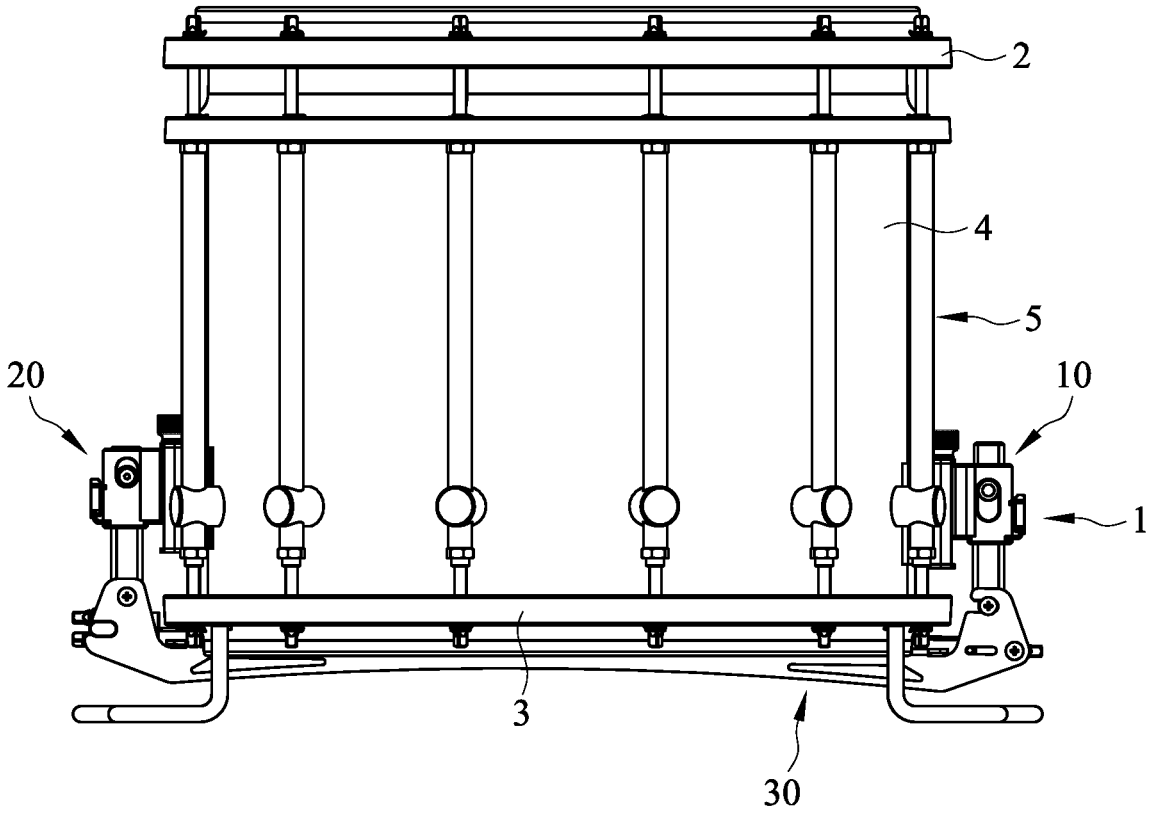
FIG. 1 is a perspective view showing a snare drum in accordance with an embodiment of the present invention.

Embodiments of the invention are now described and illustrated in the accompanying drawings, instances of which are to be interpreted to be to scale in some implementations while in other implementations, for each instance, not. In certain aspects, use of like or the same reference designators in the drawings and description refers to the same, similar or analogous components and/or elements, while according to other implementations the same use should not. According to certain implementations, use of directional terms, such as, top, bottom, left, right, up, down, over, above, below, beneath, rear, front, clockwise, and counterclockwise, are to be construed literally, while in other implementations the same use should not. While the invention will be described in conjunction with these specific embodiments, it will be understood that it is not intended to limit the invention to these embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well-known process operations and components are not described in detail in order not to unnecessarily obscure the present invention. While drawings are illustrated in detail, it is appreciated that the quantity of the disclosed components may be greater or less than that disclosed, except where expressly restricting the amount of the components.

FIG. 1 is a perspective view showing a snare drum according to an embodiment of the present invention. In this embodiment, components of the snare drum may include, but are not limited to, a strainer assembly 1, an upper hoop 2, a lower hoop 3, a shell 4, and a plurality of lug mechanisms 5. The upper hoop 2 is used to hold an upper drumhead (not shown) above the shell 4, and the lower hoop 3 is used to hold a bottom drumhead (not shown) below the shell 4. The lug mechanisms 5 are connected to the upper hoop 2 and/or the lower hoop 3 to adjust the tension of the upper drumhead and/or the bottom drumhead.

Figure 2:
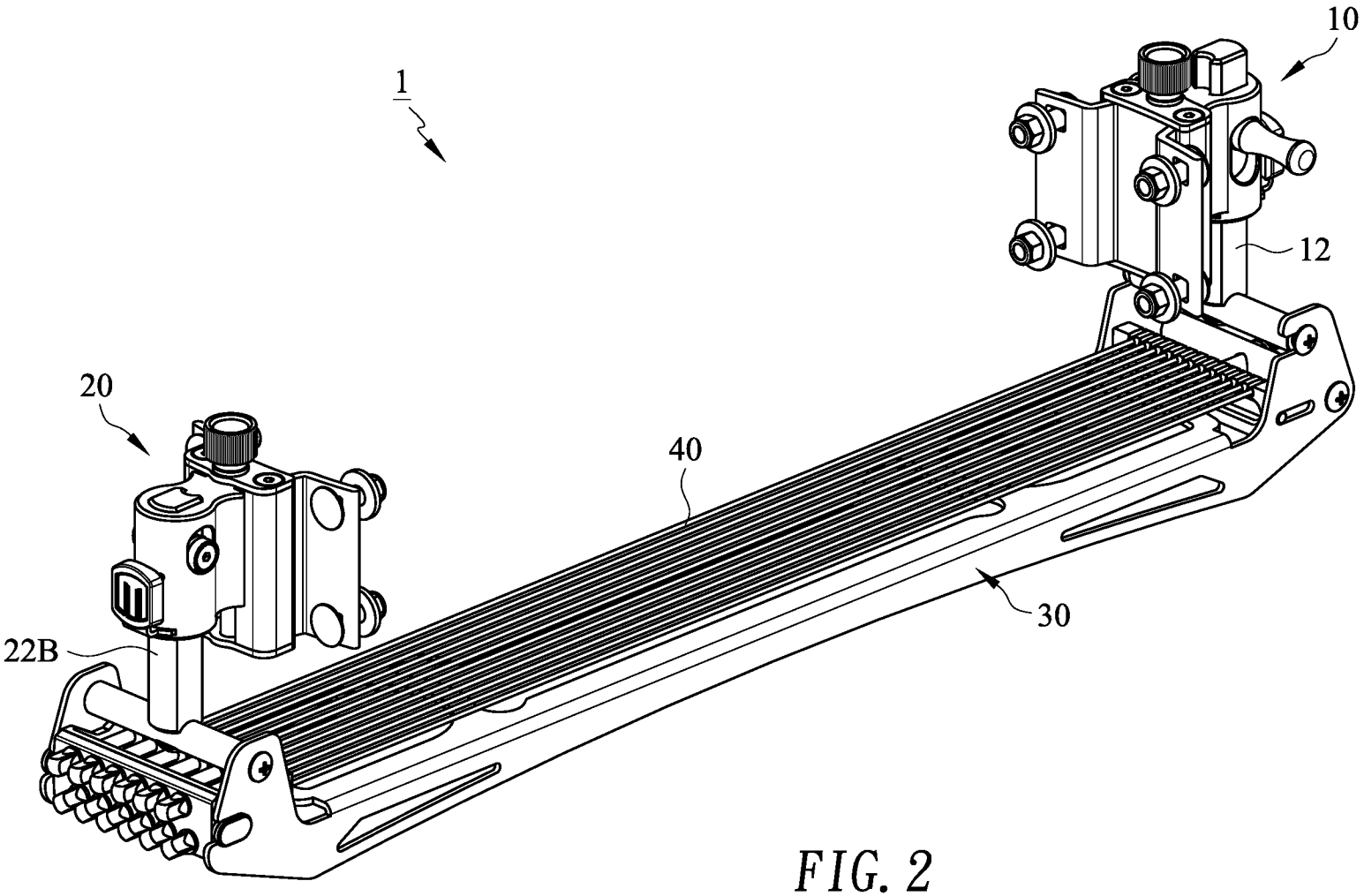
FIG. 2 is a perspective view showing a strainer assembly for a snare drum in accordance with a preferred embodiment of the present invention.

FIG. 2 is a perspective view showing a strainer assembly 1 in accordance with a preferred embodiment of the present invention. As shown in FIGS. 1 and 2, the strainer assembly 1 mainly includes a control mechanism 10, a throw-off mechanism 20, a frame 30, and a plurality of snare wires 40. The throw-off mechanism 20 and the control mechanism 10 are fixed to the left side and right side of the shell 4, respectively. The snare wires 40 are disposed within the frame 30, which includes a first end coupling to the control mechanism 10 and a second end coupling to the throw-off mechanism 20.

Figure 3:
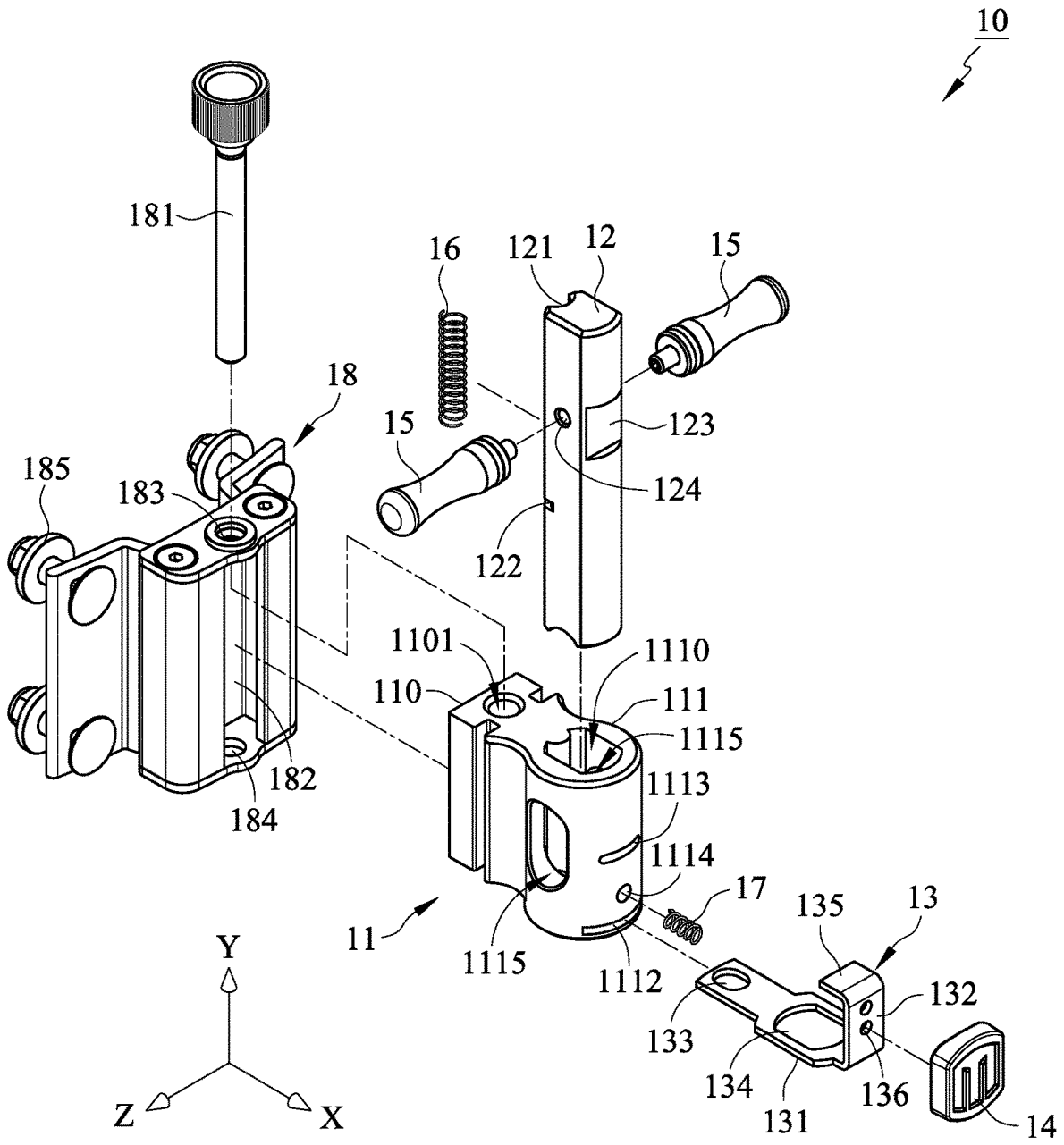
FIG. 3 is an exploded view showing a control mechanism of the strainer assembly in accordance with the preferred embodiment of the present invention.

FIG. 3 is an exploded view of the control mechanism 10 of FIG. 2. As shown in FIG. 3, the control mechanism 10 mainly includes a first stationary base 11, a slidable part 12, a first control member 13, a first button 14, two handles 15, a first elastic member 16 (e.g., a spring), a second elastic member 17 (e.g., a spring), and a first bracket 18.

Referring to FIG. 3, the first stationary base 11 includes a fixing portion 110 and an operation portion 111. The fixing portion 110 includes a vertical through hole 1101 having an internal thread. The operation portion 111 includes a chute 1110, a first slit 1112, a second slit 1113, a recess 1114, and two openings 1115. The chute 1110 is vertically disposed within the operation portion 111. The two openings 1115 are symmetrically disposed at the left side and right side of the operation portion 111. The first slit 1112, the second slit 1113, and the recess 1114 are provided on the rear end of the operation portion 111.

Referring to FIG. 3, the first stationary base 11 is fixed with the shell 4 (FIG. 1) via the first bracket 18. In the preferred embodiment, the first bracket 18 includes a first tension-adjusting member 181, a space 182, an upper through hole 183, a lower through hole 184, and a plurality of fixing members 185. The fixing portion 110 of the first stationary base 11 is disposed in the space 182 of the first bracket 18, and the first tension-adjusting member 181 passes through the upper through hole 183, the through hole 1101, and the lower through hole 184, so that the fixing portion 110 is fixed in the space 182. The first bracket 18 is locked to the shell 4 via four fixing members 185 (for example, screws). The first tension-adjusting member 181 is threaded to engage with the internal thread of the through hole 1101. By rotating the first tension-adjusting member 181, the tension of the snare wires 40 can be adjusted.

Referring to FIG. 3, the slidable part 12 includes a first recess 121, a second recess 122, a third recess 123, and two holes 124. A portion of the slidable part 12 is disposed in the chute 1110 of the first stationary base 11 and can move up and down along the chute 1110. The first elastic member 16 (for example, a spring) is disposed between the inner wall of the operation portion 111 and the first recess 121 of the slidable part 12. Two holes 124 are located at the left side and right side of the slidable part 12, and the two handles 15 are connected to the left side and right side of the slidable part 12 through the two holes 124.

As shown in FIG. 3, the first control member 13 is an L-shaped structure composed of a first bottom plate 131 and a first side plate 132. The first bottom plate 131 includes a first opening 133 and a second opening 134. The first bottom plate 131 passes through the first slit 1112 such that the first opening 133 and the second opening 134 are located below the through hole 1101 and the chute 1110, respectively, allowing for the first tension-adjusting member 181 and the slidable part 12 to pass through. A second elastic member 17, such as a spring, passes through an aperture 136 of the first side plate 132 and is disposed between the recess 1114 and the inner wall of the first button 14. In addition, a bent portion 135 at the upper end of the first side plate 132 is placed into the second slit 1113. The first button 14 is coupled to the first side plate 132. Preferably, the first button 14 is integrally formed with the first control member 13 as a single component.

Figure 4:
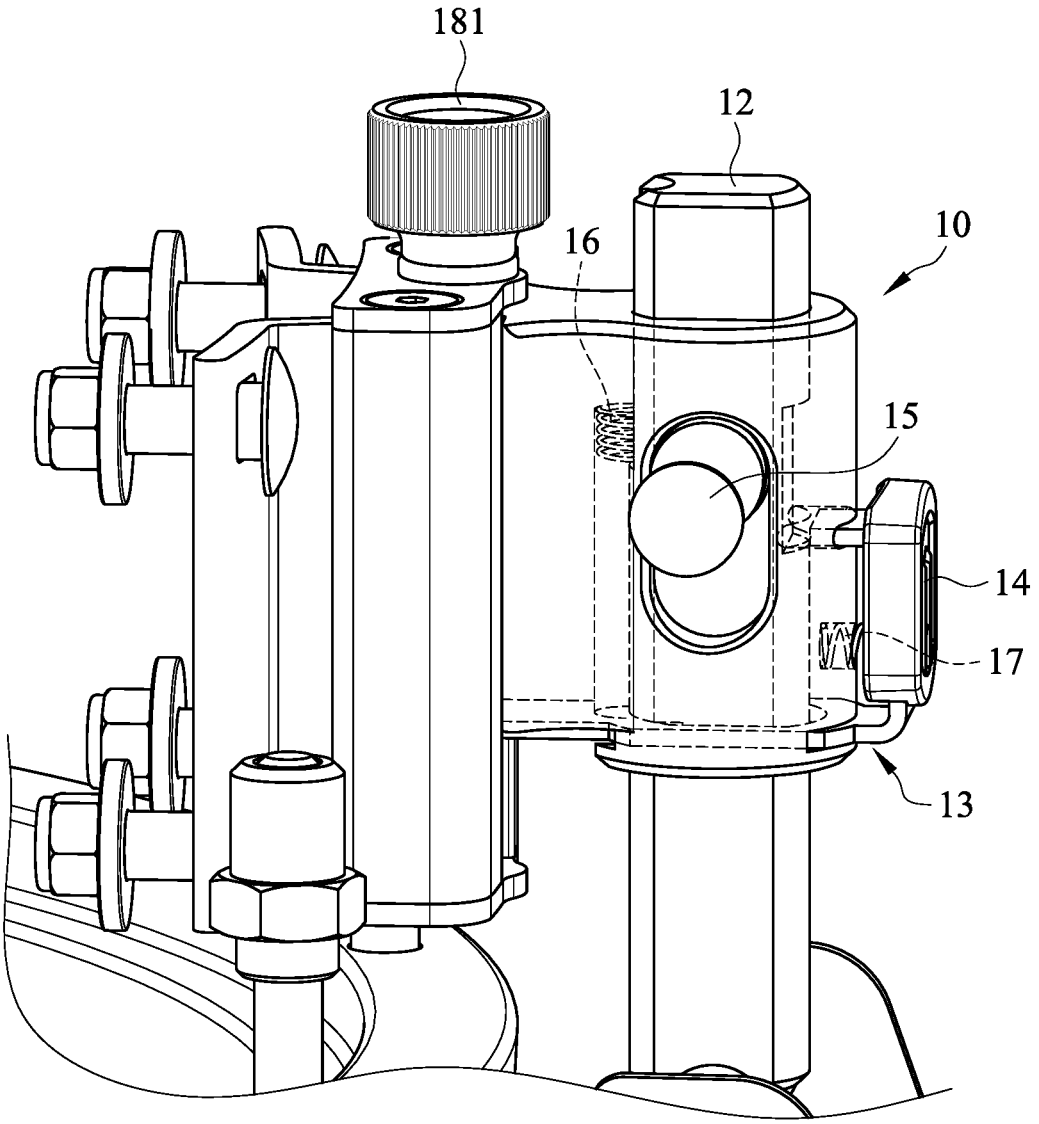
FIG. 4 is a perspective view showing the control mechanism of the strainer assembly in accordance with the preferred embodiment of the present invention.
Figure 5:
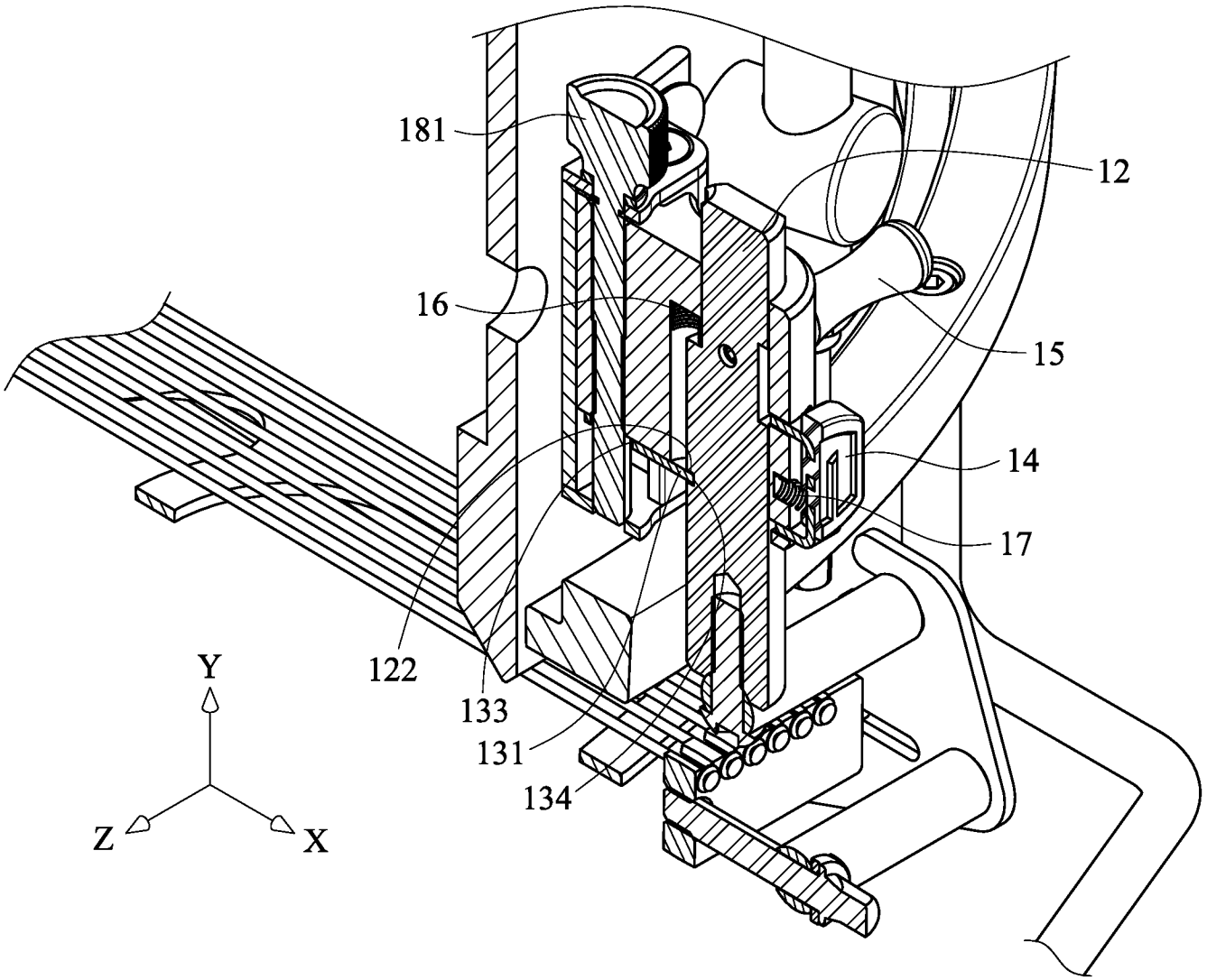
FIG. 5 is a cross-sectional perspective view showing the control mechanism of the strainer assembly in accordance with the preferred embodiment of the present invention.

FIG. 4 is a perspective view, and FIG. 5 is a cross-sectional view showing that the control mechanism 10 is operated in "snare on" state according to a preferred embodiment of the present invention. Referring to FIGS. 1-5, the first elastic member 16 provides a force for the slidable part 12 to move downward (to move in −y direction), and the second elastic member 17 supplies a force for the first control member 13 to move rearward (to move in x direction). When the drummer does not press the first button 14, the structure of the first bottom plate 131 around the second opening 134 is just embedded in the second recess 122 of the slidable part 12, so that the slidable part 12 is locked and cannot be moved downward (−y direction). When the drummer presses the first button 14, the first control member 13 is moved forward (−x direction), so that the structure of the first bottom plate 131 around the second opening 134 exits the second recess 122, causing the slidable part 12 to pass through the second opening 134 and move down. At the same time, the bent portion 135 of the upper end of the first side plate 132 is inserted into the third recess 123, and when the bent portion 135 of the upper end of the first side plate 132 abuts against the upper end of the third recess 123, the slidable part 12 is stopped from continuing to move downward. Because the slidable part 12 is connected to the first end of the frame 30, the downward movement of the slidable part 12 will result in the snare wires 40 being detached from the bottom drumhead, i.e., result in the snare off state.

Referring to FIGS. 1-5, if the control mechanism 10 is needed to return to the snare on state, the drummer presses the first button 14, lifts the handle 15 upward (y direction), and then releases the first button 14, so that the structure of the first bottom plate 131 around the second opening 134 is just embedded in the second recess 122 of the slidable part 12, and then the "snare on" state is achieved.

Figure 6:
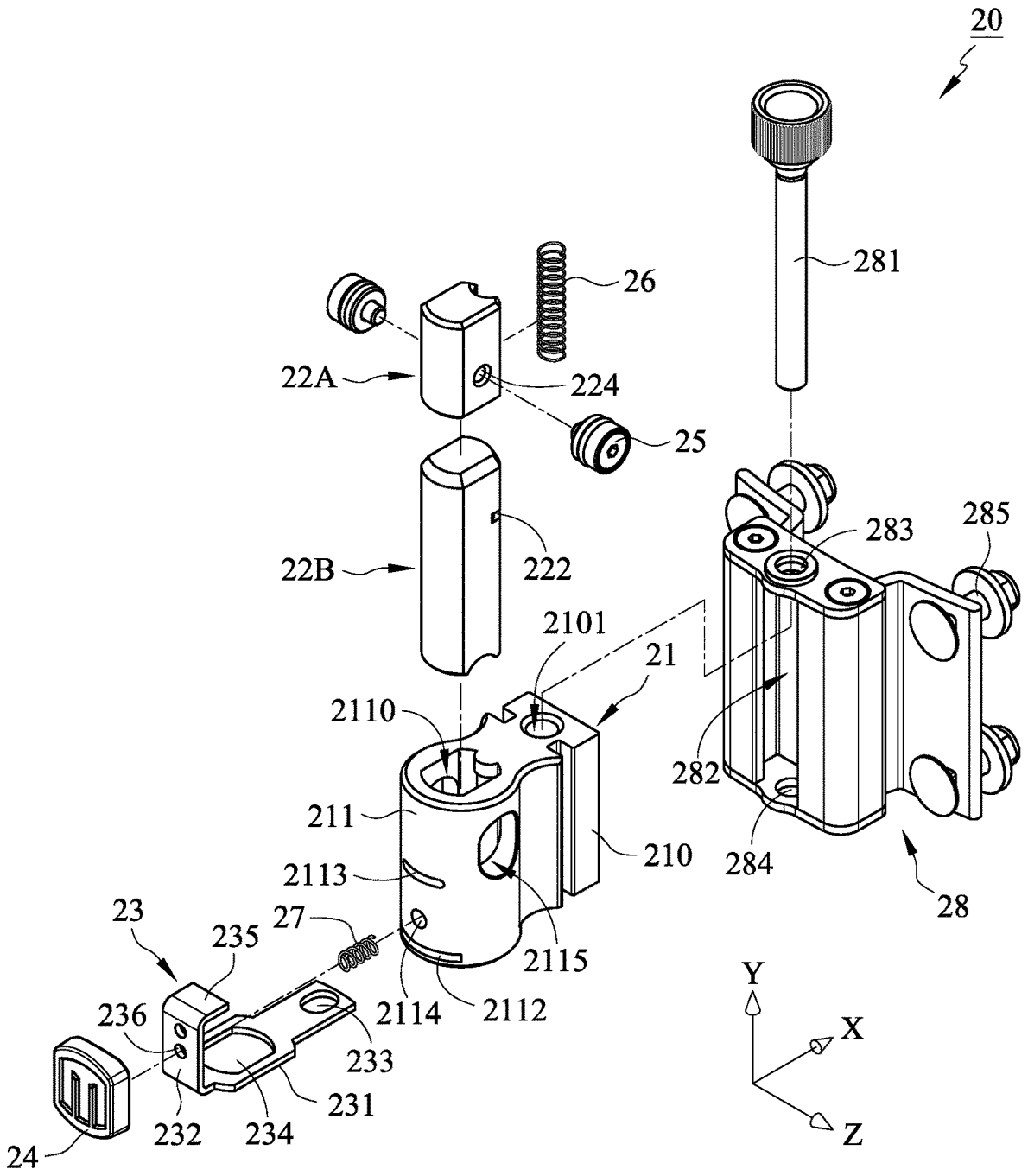
FIG. 6 is an exploded view showing a throw-off mechanism of the strainer assembly in accordance with the preferred embodiment of the present invention.

FIG. 6 is an exploded view showing the throw-off mechanism 20 of FIG. 2. As shown in FIG. 6, the throw-off mechanism 20 mainly includes a second stationary base 21, a slidable upper part 22A, a slidable lower part 22B, a second control member 23, a second button 24, two touch-protectors 25, a first spring 26, a second spring 27, and a second bracket 28.

As shown in FIG. 6, the second stationary base 21 including a fixing portion 210 and an operation portion 211. The fixing portion 210 includes a vertical through hole 2101 having an internal thread. The operation portion 211 includes a chute 2110, a first slit 2112, a second slit 2113, a recess 2114, and two openings 2115. The chute 2110 is disposed within the operation portion 211. The two openings 2115 are disposed on the left side and right side of the operation portion 111. The first slit 2112, the second slit 2113, and the recess 2114 are provided on the front end of the operation portion 211.

As shown in FIG. 6, the second stationary base 21 is fixed with the shell 4 (FIG. 1) via a second bracket 28. In this preferred embodiment, the second bracket 28 includes a second tension-adjusting member 281, a space 282, an upper through hole 283, a lower through hole 284, and a plurality of fixing members 285. The fixing portion 210 of the second stationary base 21 is disposed in the space 282 of the second bracket 28, and the second tension-adjusting member 281 passes through the upper through hole 283, the through hole 2101, and the lower through hole 284, so that the fixing portion 210 is fixed in the space 282. The second bracket 28 is locked to the shell 4 via four fixing members 285 (for example, screws). The second tensioning member 281 is threaded to engage with the internal thread of the through hole 2101. By rotating the second tension-adjusting member 281, the tension of the snare wires 40 can be adjusted.

As shown in FIG. 6, the slidable upper part 22A has a first recess 221 and two holes 224, and the slidable lower part 22B has a second recess 222. The slidable upper part 22A and the slidable lower part 22B are disposed in the chute 2110 of the second stationary base 21, and both can move up and down along the chute 2110. The first spring 26 is disposed between the inner wall of the operation portion 211 and the first recess 221 of the slidable upper part 22A. Two holes 224 are located at the left side and the right side of the slidable upper part 22A, and the two touch-protectors 25 are connected to the left side and right side of the slidable upper part 22A through the two holes 224.

As shown in FIG. 6, the second control member 23 is an L-shaped structure composed of a second bottom plate 231 and a second side plate 232. The second bottom plate 231 includes a first opening 233 and a second opening 234. The second bottom plate 231 passes through the first slit 2112 of the second stationary base 21, so that the first opening 233 and the second opening 234 are located below the through hole 2101 and the chute 2110, respectively, allowing for the second tension-adjusting member 281 and slidable lower part 22A to pass through. The second spring 27 passes through the hole 236 of the second side plate 232 and is disposed between the recess 2114 and the inner wall of the second button 24. Further, the bent portion 235 at the upper end of the second side plate 232 can be placed into the second slit 2113. The second button 24 is coupled to the second side plate 232. Preferably, the second button 24 and the second control member 23 are integrally formed as a single component.

Figure 7:
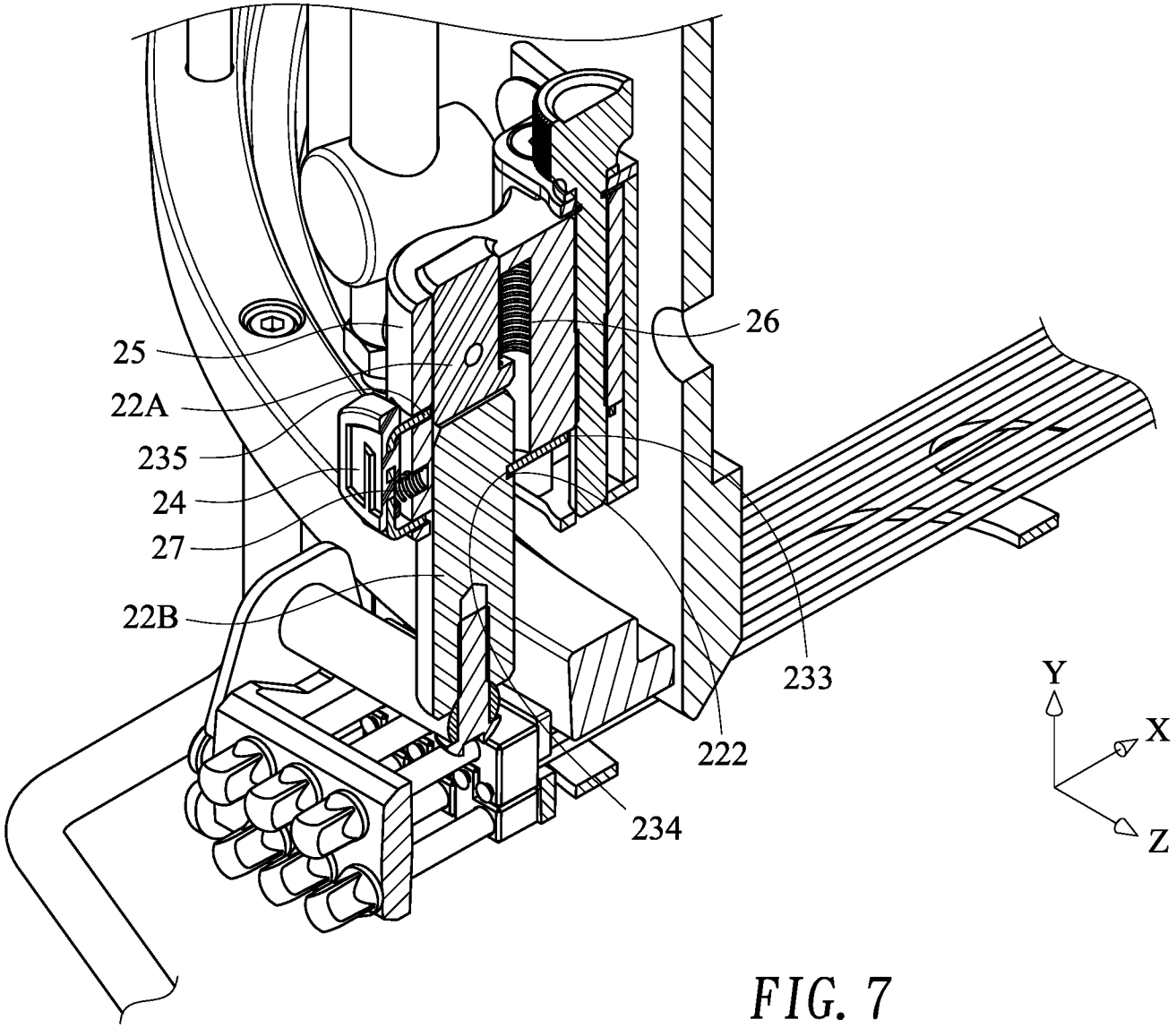
FIG. 7 is a cross-sectional perspective view showing the throw-off mechanism of the strainer assembly in accordance with the preferred embodiment of the present invention.

FIG. 7 is a cross-sectional view showing the throw-off mechanism 20 in accordance with the preferred embodiment of the present invention. As shown in FIGS. 6 and 7, the first spring 26 provides a force to move the slidable upper part 22A downward (−y direction), and the second spring 27 provides a force to move the second control member 23 forward (−x direction). In an initial state, that is, when the drummer does not press the second button 24, the structure of the second bottom plate 231 around the second opening 234 is just embedded in the second recess 222 of the slidable lower part 22B, so that the slidable lower part 22B cannot be moved down (−y direction). At this time, the second button 24 cannot be pressed because the bent portion 235 at the upper end of the second side plate 232 of the second control member 23 is blocked by the slidable upper part 22A. To quickly release the frame 30, the drummer must hold the touch-protectors 25 and pull them up, so that the slidable upper part 22A is moved upward (y direction) and can no longer block the second control member 23 to move in x direction. At the same time, the drummer presses the second button 24 to move the second control member 23 backward (x direction), so that the structure of the second bottom plate 231 around the second opening 234 exits the second recess 222, resulting in that the slidable upper part 22A moves downward to press the slidable lower part 22B moving downward through the second opening 234. Because the slidable lower part 22B is connected to the frame 30, the downward movement of the slidable lower part 22B will result in the downward movement of the frame 30 and the snare wires 40. If it is to be restored to the "snare on" state, the slidable lower part 22B is moved upward in the reverse order of the above-mentioned steps, so that the structure of the second bottom plate 231 around the second opening 234 is just embedded in the second recess 222 of the slidable lower part 22B.

Figure 8:
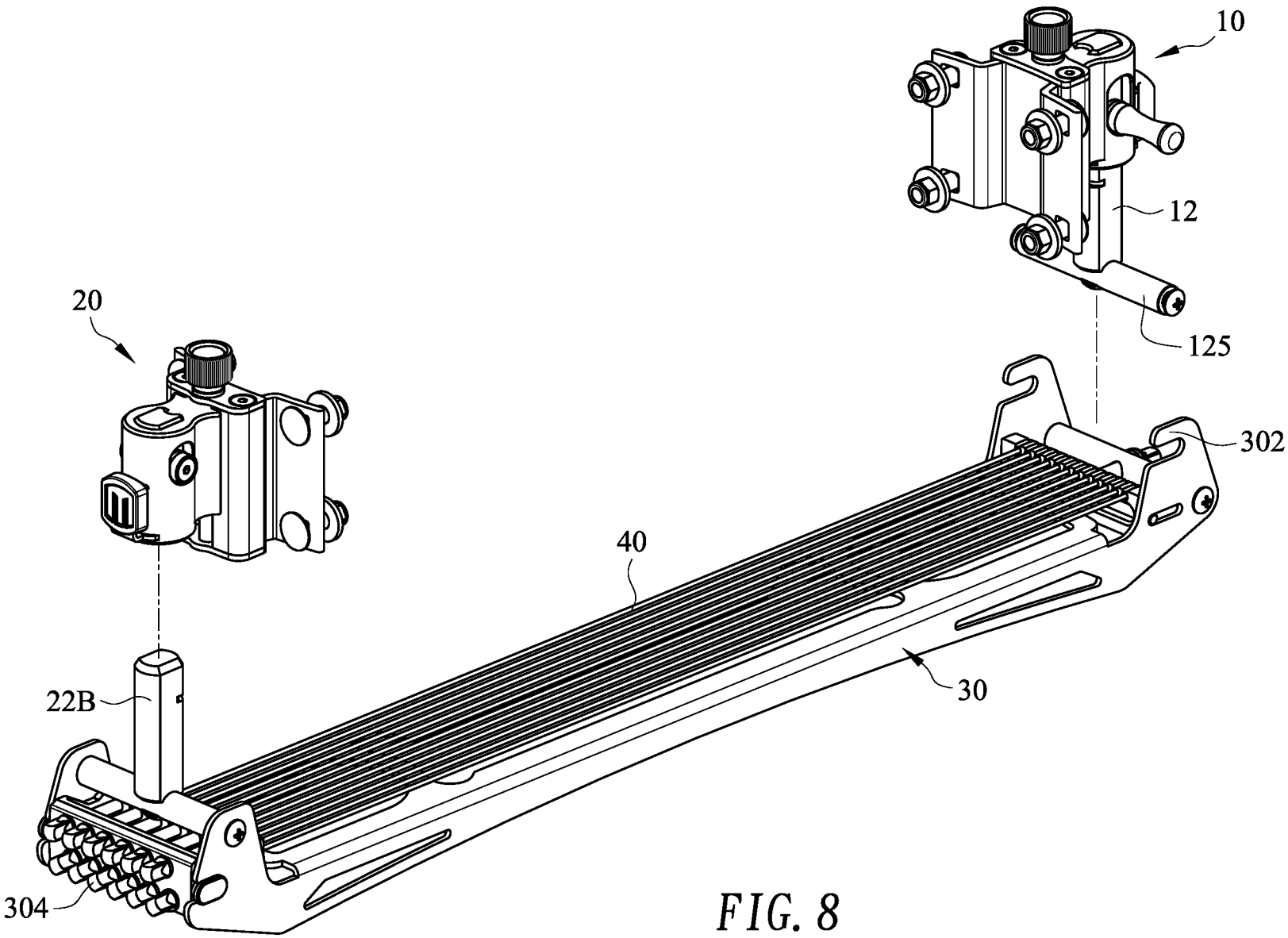
FIG. 8 is a schematic view showing a frame detached from strainer assembly according to the preferred embodiment of the present invention.

As shown in FIG. 8, when the control mechanism 10 and the throw-off mechanism 20 are operated to move both the slidable part 12 and the left slidable lower part 22B downward, and two slits 302 of the frame 30 are separated from a horizontal link rod 125 coupling to the lower end of the slidable part 12, the entire frame 30 is detached from the strainer assembly 1. In addition, one end of each snare wires 40 is independently fixed to the frame 30 through a fixing member 304, and any one of the snare wires 40 can be replaced if necessary.

According to the strainer assembly 1 provided by the embodiments of the present invention, the drummer can switch the effect by simply and quickly operating the control mechanism 10 while marching. Even if the snare wires 40 are adjusted to a high tension, the operation of the control mechanism 10 is easy and quick. In addition, the strainer assembly 1 has simple and durable mechanism, and the snare wires 40 can be quickly disassembled together with the frame 30. The drummer can conveniently adjust the tension and tone of the snare wire 40, or replace a single snare wire 40 as needed. There is no need to replace the entire set of snare wires due to one of them is damaged.

The intent accompanying this disclosure is to have each/all embodiments construed in conjunction with the knowledge of one skilled in the art to cover all modifications, variations, combinations, permutations, omissions, substitutions, alternatives, and equivalents of the embodiments, to the extent not mutually exclusive, as may fall within the spirit and scope of the invention. Corresponding or related structure and methods disclosed or referenced herein, and/or in any and all co-pending, abandoned or patented application(s) by any of the named inventor(s) or assignee(s) of this application and invention, are incorporated herein by reference in their entireties, wherein such incorporation includes corresponding or related structure (and modifications thereof) which may be, in whole or in part, (i) operable and/or constructed with, (ii) modified by one skilled in the art to be operable and/or constructed with, and/or (iii) implemented/made/used with or in combination with, any part(s) of the present invention according to this disclosure, that of the application and references cited therein, and the knowledge and judgment of one skilled in the art.

Conditional language, such as, among others, "can," "could," "might," or "may," unless specifically stated otherwise, or otherwise understood within the context as used, is generally intended to convey that embodiments include, and in other interpretations do not include, certain features, elements and/or steps. Thus, such conditional language is not generally intended to imply that features, elements and/or steps are in any way required for one or more embodiments, or interpretations thereof, or that one or more embodiments necessarily include logic for deciding, with or without user input or prompting, whether these features, elements and/or steps are included or are to be performed in any particular embodiment.

All of the contents of the preceding documents are incorporated herein by reference in their entireties. Although the disclosure herein refers to certain illustrated embodiments, it is to be understood that these embodiments have been presented by way of example rather than limitation. For example, any of the particulars or features set out or referenced herein, or other features, including method steps and techniques, may be used with any other structure(s) and process described or referenced herein, in whole or in part, in any combination or permutation as a non-equivalent, separate, non-interchangeable aspect of this invention. Corresponding or related structure and methods specifically contemplated and disclosed herein as part of this invention, to the extent not mutually inconsistent as will be apparent from the context, this specification, and the knowledge of one skilled in the art, including, modifications thereto, which may be, in whole or in part, (i) operable and/or constructed with, (ii) modified by one skilled in the art to be operable and/or constructed with, and/or (iii) implemented/made/used with or in combination with, any parts of the present invention according to this disclosure, include: (I) any one or more parts of the above disclosed or referenced structure and methods and/or (II) subject matter of any one or more of the inventive concepts set forth herein and parts thereof, in any permutation and/or combination, include the subject matter of any one or more of the mentioned features and aspects, in any permutation and/or combination.

Although specific embodiments have been illustrated and described, it will be appreciated by those skilled in the art that various modifications may be made without departing from the scope of the present invention, which is intended to be limited solely by the appended claims.

What is claimed is:

1. A strainer assembly for a snare drum having a shell and a bottom drumhead, comprising:

a plurality of snare wires with each having a first end and a second end;

a frame coupling with the first end and the second end of each of the plurality of the snare wires;

a control mechanism comprising:

a first stationary base connecting to the shell;

a slidable part being vertically movable in a chute of the first stationary base;

a first control member comprising a first bottom plate inserted into the first stationary base, the first bottom plate comprising an opening and being placed at an initial position to block vertical movement of the slidable part;

a first button connecting to the first control member and being pressed to control a horizontal movement of the first bottom plate so as to allow the slidable part to vertically pass through the opening; and a throw-off mechanism comprising a slidable lower part connecting to a second end of the frame and a second button configured to control vertical movement of the slidable lower part.

2. The strainer assembly as recited in claim 1, further comprising a first elastic member disposed in a first recess of the slidable part to provide a force to move the slidable part downward.

3. The strainer assembly as recited in claim 1, further comprising a second elastic member disposed between the first stationary base and the first control member to provide a force to return the first button to its initial position.

4. The strainer assembly as recited in claim 1, further comprising a first bracket to fix the first stationary base with the shell, wherein the first bracket comprises a first tension-adjusting member connecting to the first stationary base, and the first tension-adjusting member is configured to adjust a tension of the plurality of snare wires.

5. The strainer assembly as recited in claim 1, further comprising two handles respectively connected to the left side and right side of the slidable part.

6. The strainer assembly as recited in claim 1, wherein the throw-off mechanism further comprises:

a second stationary base connecting to the shell, wherein the slidable lower part is capable of being vertically moved in a chute of the second stationary base;

a second control member connecting to the second button, the second button controlling a horizontal movement of the second control member so as to block or allow vertical movement of the slidable lower part;

a slidable upper part vertically movable in the chute of the second stationary base and located above the slidable lower part, the slidable upper part being located at an initial position to block the second control member so that the second button cannot be pressed; and two touch protector connecting to the slidable upper part and being manually operated to move the slidable upper part so that the second button can be pressed.

7. The strainer assembly as recited in claim 6, further comprising a first spring disposed in a first recess of the slidable upper part to provide a force to move the slidable upper part downward.

8. The strainer assembly as recited in claim 6, further comprising a second spring disposed between the second stationary base and the second control member to provide a force to return the second button to its initial position.

9. The strainer assembly as recited in claim 6, further comprising a second bracket, wherein the second stationary base is connected to the shell through the second bracket, and the second bracket comprises a second tension-adjusting member connecting to the second stationary base, and the second tension-adjusting member is used for adjusting the tension of the plurality of snare wires.

10. The strainer assembly as recited in claim 1, wherein the first end of the frame comprises two slits to receive a horizontal link rod connecting to a lower end of the slidable part.

* * * * *